US007434509B2

(12) United States Patent
Winston

(10) Patent No.: US 7,434,509 B2
(45) Date of Patent: Oct. 14, 2008

(54) GUIDE SYSTEM FOR FORMING INK IMAGES

(75) Inventor: Jeffrey M. Winston, Anacortes, WA (US)

(73) Assignee: Clearsnap Holding, Inc., Anacortes, WA (US)

( * ) Notice: Subject to any disclaimer, the term of this patent is extended or adjusted under 35 U.S.C. 154(b) by 0 days.

(21) Appl. No.: 11/118,859

(22) Filed: Apr. 29, 2005

(65) Prior Publication Data

US 2005/0241508 A1 Nov. 3, 2005

Related U.S. Application Data

(60) Provisional application No. 60/567,015, filed on Apr. 29, 2004.

(51) Int. Cl.
*B41B 1/00* (2006.01)

(52) U.S. Cl. ..... 101/400; 101/127.1; 101/368; 33/452; 33/465; 33/614; 33/622

(58) Field of Classification Search ..... None
See application file for complete search history.

(56) References Cited

U.S. PATENT DOCUMENTS

| | | | | | |
|---|---|---|---|---|---|
| 548,533 | A * | 10/1895 | Foster | 33/622 |
| 1,623,291 | A * | 4/1927 | West | 33/36 |
| 1,838,383 | A * | 12/1931 | Fridolph | 101/400 |
| 1,958,628 | A * | 5/1934 | Lamb et al. | 101/269 |
| 1,994,046 | A * | 3/1935 | Newbaker | 33/622 |
| 2,868,123 | A * | 1/1959 | Martin et al. | 101/400 |
| 3,896,725 | A * | 7/1975 | Grover | 101/330 |
| 4,375,191 | A * | 3/1983 | Dickey | 101/333 |
| 4,688,333 | A * | 8/1987 | Welch | 33/614 |
| 5,020,233 | A * | 6/1991 | Syken | 33/465 |
| 5,174,036 | A | 12/1992 | Lin | |
| 5,193,284 | A | 3/1993 | Lin | |
| 5,459,935 | A * | 10/1995 | Paulson et al. | 33/451 |
| 5,675,901 | A * | 10/1997 | Young | 33/465 |
| 5,694,855 | A * | 12/1997 | Gardner | 101/474 |
| 6,141,882 | A * | 11/2000 | Syken | 33/465 |
| 6,615,719 | B1 * | 9/2003 | Winston | 101/327 |
| 6,804,895 | B2 * | 10/2004 | Shapiro | 33/471 |
| 2003/0000096 | A1 * | 1/2003 | Wang | 33/458 |

FOREIGN PATENT DOCUMENTS

| | | |
|---|---|---|
| FR | 2 294 857 | 7/1976 |
| GB | 1 196 169 | 6/1970 |
| JP | 8 112997 | 5/1996 |

* cited by examiner

*Primary Examiner*—Jill E. Culler
(74) *Attorney, Agent, or Firm*—Michael R. Schacht; Schact Law Office, Inc.

(57) ABSTRACT

A guide system comprising a plurality of guide members, where each guide member comprises an exposed surface and an intermediate portion between first and second end portions. The first end portion comprises a deformable detent member defining a detent projection. The second end portion defines at least first, second, and third detent edges defining a detent opening. The guide system operates in storage configuration and a plurality of use configurations. In the storage configuration, detent members of two guide members extend through detent opening of the two guide members. In the use configurations, a detent member extends through one of the detent openings such that longitudinal axes of the first and second guide members are substantially co-linear or perpendicular and the exposed faces of the first and second guide members are substantially coplanar.

21 Claims, 11 Drawing Sheets

20
22
58a
86b
80a
86a
58a
84
86c
52
60
78
24
32
3
3
30
78
94b
94c
92c
90
94d
58a
94a
92b
92a
92d
78
28
26
50
58b
54
78
62
80b
86d 20
22
72
90
94d
94a
50
28
54
62
78
56b
56a
30
46
24
42
36
T
34
R
44
32
78
80b
84
86d
70
80a
86a
26

20
22
62
54
56a
50
56b
26
46
32
60
52
40
36
38
44
24
30
48
42
34

GUIDE SYSTEM FOR FORMING INK IMAGES

RELATED APPLICATIONS

This application claims priority of U.S. Provisional Patent Application Ser. No. 60/567,015 filed Apr. 29, 2004.

FIELD OF THE INVENTION

The present invention relates to systems and methods for forming ink images and, more specifically, guide systems for facilitating the formation of ink images with conventional flat and continuous inking assemblies.

BACKGROUND OF THE INVENTION

The present invention relates ink stamping systems and methods in which an ink impression is formed on an image surface. The ink is applied to a stamp member on which a design is formed in bas relief. The stamp member with ink thereon is brought into contact with the image surface such that ink is transferred to the image surface to form an ink impression or image in a configuration corresponding to the design on the stamp member.

The present invention is of particular importance in the formation of artistic rather than commercial ink impressions. Art stamping uses the same basic ink stamping process as commercial ink stamping but has evolved to allow more precise creative control over the details and quality of the resulting ink impression. The principles of the present invention may also have application to commercial ink stamping, however.

Ink stamping systems for use by art stampers are designed and constructed primarily to obtain a high quality ink impression, with flexibility of use also being of importance. Considerations such as repeatability of the ink impression, ease of use, and durability of the stamping devices are of lesser importance than in the commercial ink stamping environment.

In one conventional form, an inking assembly comprises a stamp member formed by flat sheet of rubber. A design formed in bas relief on a first surface of the stamp member. A second surface of the stamp member is typically supported by a rigid member, sometimes with a handle that facilitates manipulation of the stamp member.

Continuous inking assemblies that form a continuous, repeated ink image are also known. Such inking assemblies comprise a stamping wheel that supports a stamp member defining a cylindrical stamping surface. The design formed in bas relief on the stamp member is formed on the outer surface of the stamp member. The stamp member is mounted on a handle or handle assembly such that the handle can be grasped to roll the stamp member along an ink pad and then along an inking surface to form the desired ink impression on the inking surface. In some continuous inking assemblies, the ink pad is also mounted to the handle such that ink is continuously applied to the outer member of the stamp member as the stamp member rolls along the inking surface.

The need exists for improved systems and methods for creating ink impressions utilizing one or both of flat inking assemblies and continuous inking assemblies.

SUMMARY OF THE INVENTION

The present invention may be embodied as an inking system or method for forming an ink image on an inking surface comprising a guide system and an inking assembly. The guide system defines at least one side edge surface and is arranged in a desired orientation on the inking surface. The inking assembly is used to form an ink image on the inking surface. In particular, the at least one side edge surface of the guide system is sized and dimensioned to engage the at least one inking assembly such that the ink image is formed at a desired location on the inking surface.

DETAILED DESCRIPTION OF THE PREFERRED EMBODIMENTS

Figure 1:
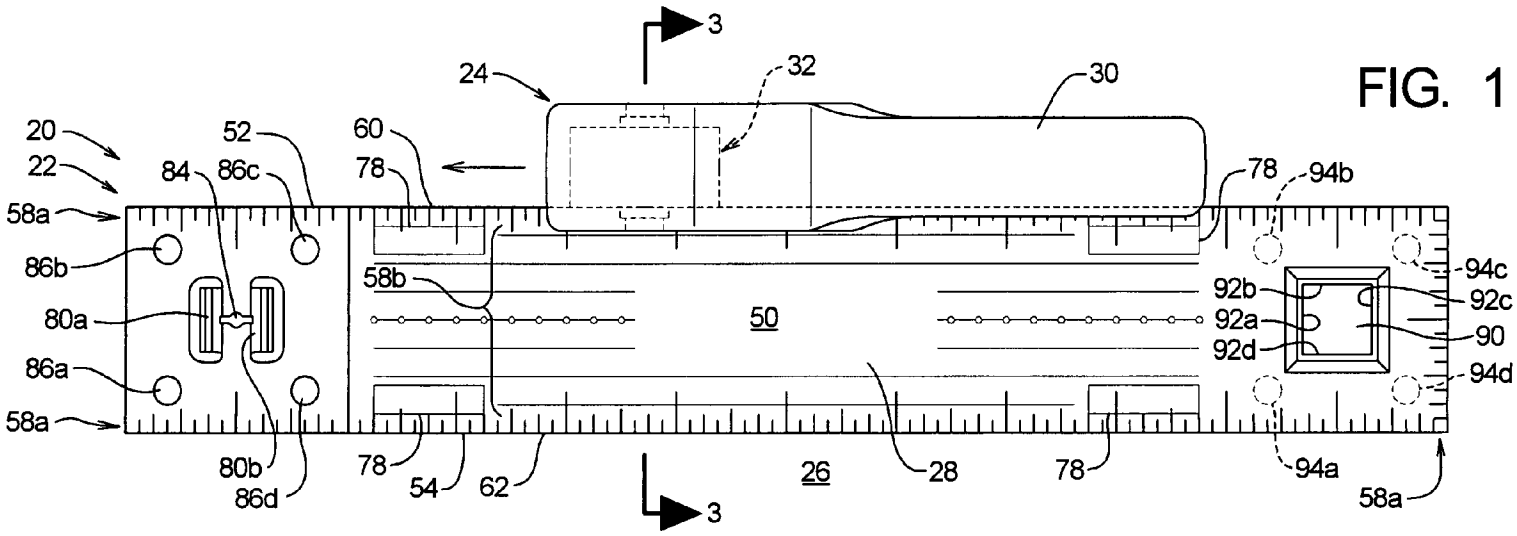
FIG. 1 is a top plan view of an inking system comprising a guide system and continuous inking assembly.

Referring initially to FIG. 1, depicted at 20 therein is a stamping system constructed in accordance with, and embodying, the principles of the present invention. The stamping system 20 comprises a guide system 22 and an inking assembly 24 and is used to form ink images on a printing surface 26. The guide system 22 may comprise one or more guide members 28 as shown.

In use, the guide system 22 is laid on the printing surface 26 at a ruler location adjacent to a desired location at which an ink image is to be formed. The inking assembly 24 is then placed on the printing surface 26 within the desired location and adjacent to the guide system 22. The inking assembly 24 is then displaced along the printing surface 26 within the desired location to apply ink to the printing surface in the desired location. The inking assembly 24 is held against the guide system 22 such that the guide system 22 guides the inking assembly 24 along a substantially straight inking path to form the image at the desired location.

The inking assembly 24 is not per se part of the present invention and will be described herein only to the extent necessary for a complete understanding of the present invention. The example inking assembly 24 is or may be a conventional inking assembly comprising a handle assembly 30 and a wheel assembly 32. The wheel assembly 32 comprises a hub member 34 and a stamp member 36. The hub member 34 defines a substantially cylindrical stamp surface 40 and a hub portion 42 aligned with the axis of the support surface 40. The hub portion 42 engages the handle assembly 30 such that the wheel assembly 32 rotates relative to the handle assembly 30.

As is conventional, the example inking assembly 24 may further comprise an ink cartridge (not shown) that continuously applies ink to the stamp member 36 as the stamp member 36 moves relative to the handle assembly 30. Alternatively, the inking assembly 24 may not include an ink cartridge, in which case a user may grip the handle assembly 30, roll the wheel assembly 32 along an ink pad, and then roll the wheel assembly 32 along the inking surface 44.

The wheel assembly 32 defines first and second side surfaces 46 and 48. The side surfaces 46 and 48 are formed by the edge portions of the hub member 34 and the stamp member 36. The side surfaces 46 and 48 are generally annular and substantially parallel with each other. The portion of the example side surfaces 46 and 48 formed by the stamp member 36 has a radial thickness dimension indicated by reference character T; the side surfaces 46 and 48 define an outer radius dimension of the wheel assembly 32 indicated by reference character R in FIG. 2.

Figure 4:
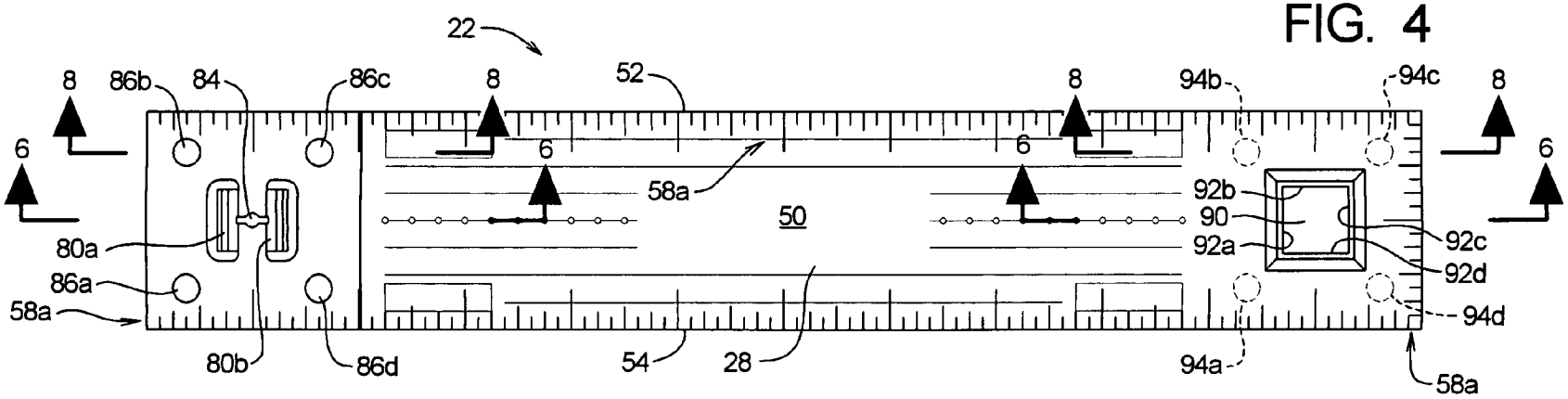
FIG. 4 is a top plan view of the guide system depicted in FIG. 1.

With the foregoing general understanding of the inking assembly 24 in mind, the construction and operation of the example guide system 22 will now be described in further detail. Referring initially to FIGS. 1, 4 and, 5, it can be seen that the guide member 28 defines an exposed surface 50, first and second side edges 52 and 54, an edge surface 56*a*, an inner surface 56*b*, and first and second sets of indicia 58*a* and 58*b* optionally formed on the exposed surface 50.

During normal use, the edge surface 56*a* rests on the printing surface 26 and the exposed surface 50 is arranged such that the indicia 58*a* and 58*b* are visible to the user. Additionally, the example guide member 28 is optionally made of a clear material such that the printing surface 26 is visible through the guide member 28. Using the example guide member 28, the user may thus view both the indicia 58*a* and 58*b* on the exposed surface 50 and the printing surface 26 on the other side of the exposed surface 50.

The optional indicia 58*a* and 58*b* may be used to measure, locate, and/or align other devices with the printing surface 26. The first group of indicia 58*a* takes the form of ruler markings along at least the side edges 52 and 54. The first set of indicia 58*a* thus may be used to make measurements, such as distances from an edge of a sheet of paper forming the printing surface 26. The second group of indicia 58*b* takes the form of spaced lines parallel to the edges 52 and 54; these indicia 58*b* facilitate alignment of the edges 52 or 54 with a line, such as an edge of a sheet of paper, visible below the exposed surface 50.

Figure 5:
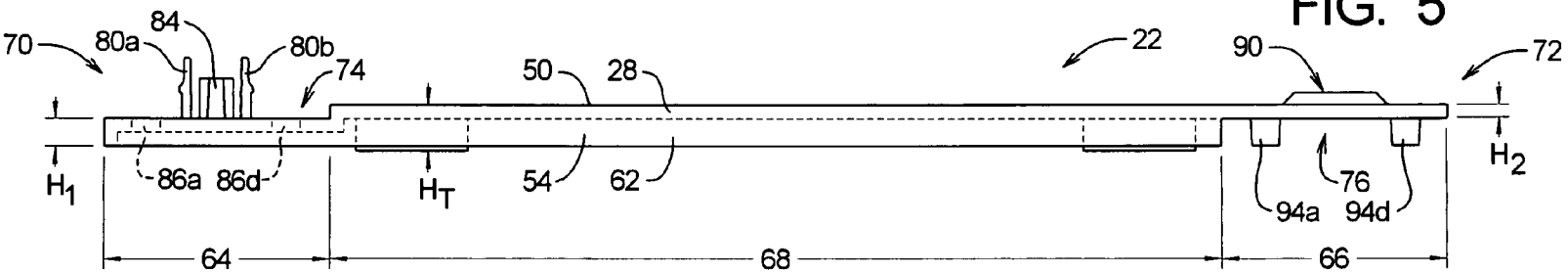
FIG. 5 is a side elevation view of the guide system of FIG. 4.
Figure 6:
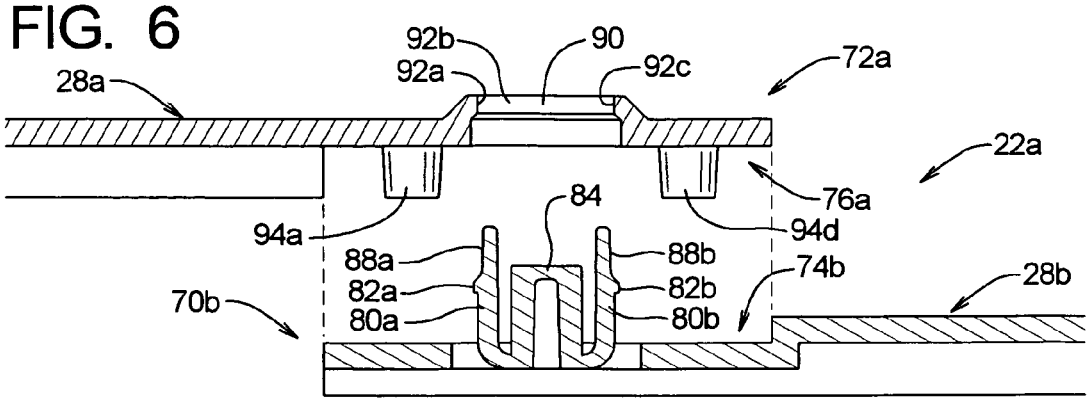
FIGS. 6-7 are cutaway views taken generally along lines 6-6 in FIG. 4 illustrating the engagement of first and second attachment portions of the guide system of FIG. 4.
Figure 7:
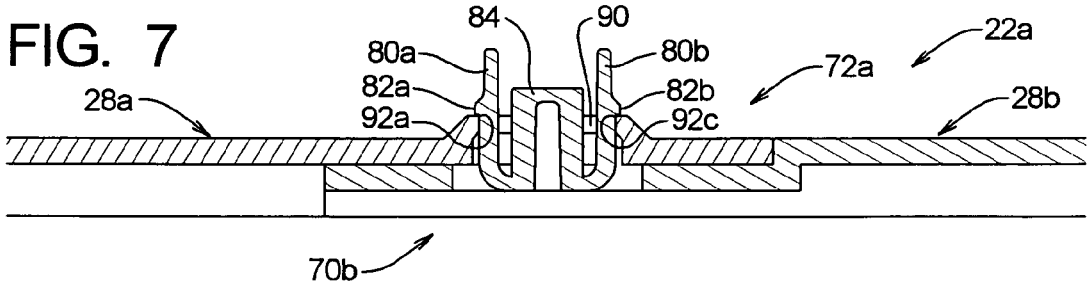
Figure 8:
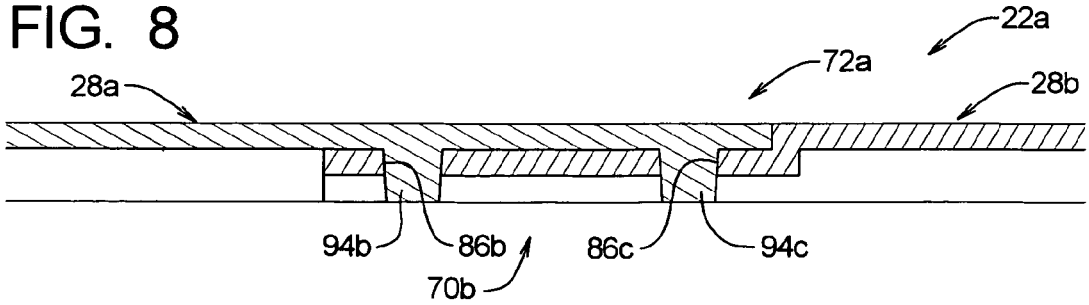
FIG. 8 is a cutaway view taken along lines 8-8 in FIG. 4 further illustrating the engagement of the first and second attachment portions of the guide system of FIG. 4.

As perhaps best shown in FIG. 5, the guide member 28 defines first and second side edge surfaces 60 and 62. The side edge surfaces 60 and 62 each define first and second end portions 64 and 66 and an intermediate portion 68. A configuration of the side edge surfaces 60 and 62 between the exposed surface 50 and the edge surface 56*a* is different in the first end portion 64, the second end portion 66, and the intermediate portion 68.

In particular, FIG. 5 illustrates that the height dimension of the surfaces 60 and 62 in the intermediate portion 68 and the first and second end portions 64 and 66 are referred to as $H_T$, $H_2$, and $H_3$, respectively. In the example guide member 28, the height dimension $H_T$ is greater than the height dimension $H_1$, and the height dimension $H_1$ is in turn greater than the height dimension $H_2$. In particular, the example height dimensions are related by the following formula:

$$H_T=H_1+H_2 \quad (1).$$

Although the present invention may be embodied with different relationships between the various height values $H_T$, $H_1$, and $H_2$, the relationship described above may be advantageous for reasons that will become apparent from the following discussion.

The exact dimensions of the height values $H_T$, $H_1$, and $H_2$ are also not critical but should be selected based on the characteristics of the inking assembly 24 or any other inking assembly that will be used with the guide system 22.

In the example inking system 20, the height value $H_T$ is selected to maximize stability of the inking assembly 24 when used in conjunction with the guide system 22. In particular, in the system 20 the height value $H_T$ is selected such that the height value $H_T$ equal to or greater than the thickness dimension T of the stamp member 36. Expressed as a percentage of the radius dimension R of the stamp member 36, the height value $H_T$ is preferably in a first range of between approximately 20% to 75% and should in any event be within a second rage of between approximately 8% to 100%. In the example inking system 20, the height value $H_T$ is approximately 44-50% of the radius dimension R of the stamp member 36.

The foregoing parameters allow the ruler side edge surfaces 60 and 62 to engage a relatively large percentage of either the first or second side surfaces 46 and 48 of the wheel assembly 32, thereby improving the ability of the guide system 22 to guide the inking assembly 24 as generally described above.

Figure 2:
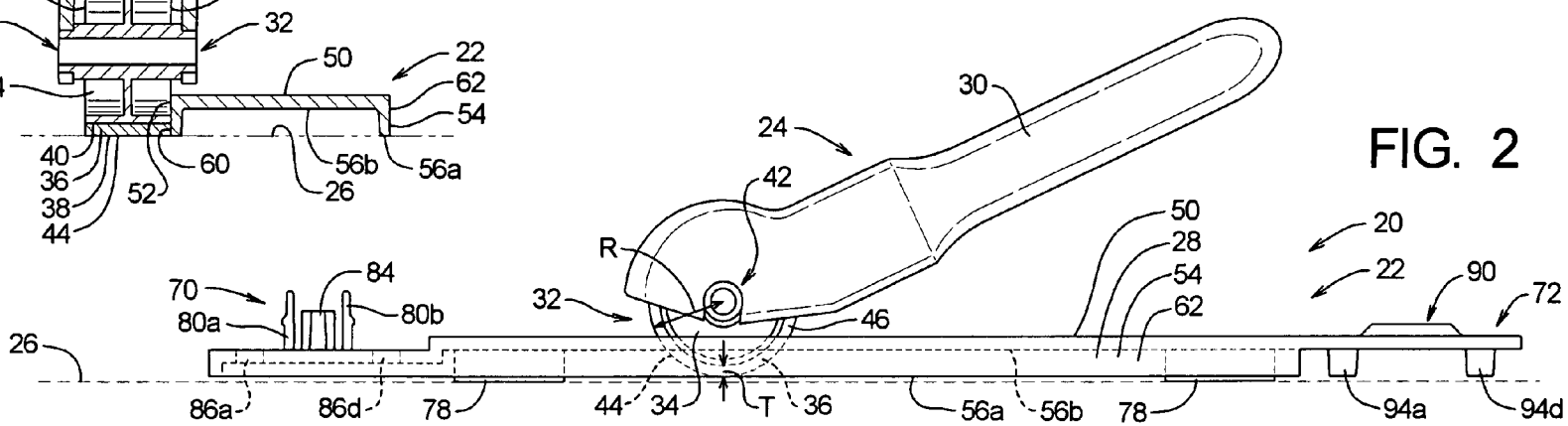
FIG. 2 is a side elevation view of the inking system of FIG. 1.
Figure 3:
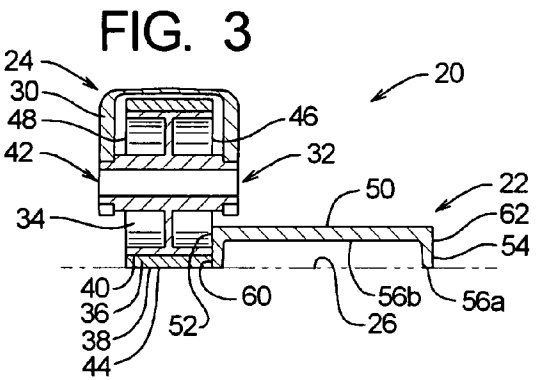
FIG. 3 is a cut-away view taken along lines 3-3 in FIG. 1.

The example guide system 22 is designed to be used with a single guide member 28, as shown in FIGS. 1-3, or, optionally, with a combination of guide members as shown, for example, in FIGS. 6-10. In particular, depicted at 22*a* in FIGS. 6-9 is a straight combined configuration, while an angled combined configuration is depicted at 22*b* in FIG. 10.

To allow separate guide members 28 to be combined as shown in FIGS. 6-10, first and second types of attachment portions 70 and 72 are formed on each of the example guide members 28. As will be described in detail below, attachment portions 70 of the first type are adapted to engage attachment portions 72 of the second type to detachably attach two guide members 28 together.

As perhaps best shown in FIGS. 5-8, the first end portion 64 of the guide member 28 forms a first notch portion 74 in the exposed surface 50. Similarly, the second end portion 66 of the guide member 28 forms a second notch portion 76 in the edge surface 56*a*. The notches 74 and 76 are offset from each other and, as indicated by equation (1) above, complimentary in thickness. Given the relationships among the height values $H_T$, $H_1$, and $H_2$ described above, when first and second guide members 28*a* and 28*b* are combined in any of the combinations shown in FIGS. 9 and 10, the total height of the combinations 22*a* and 22*b* at the attachment portions 70*a* and 70*b* is equal to $H_T$. Accordingly, when the attachment portions 70 and 72 are joined to combine two different guide members 28, a substantial portion of the exposed surfaces 50 of the attached guide members 28 are substantially coplanar.

FIGS. 1, 2, 4 and 5 of the drawing illustrate that feet members 78 may be secured to the inner surface 56*b* of the guide member 28. If used, the feet members 78 engage the printing surface 26 to inhibit relative movement between the printing surface 26 and the guide system 22.

The details of construction and use of the attachment portions 70 and 72 will now be described in further detail with reference to FIGS. 4-8. The first attachment portions 70 comprise detent members 80*a* and 80*b* on which are formed detent projections 82*a* and 82*b*, respectively, a center post 84 formed between the detent members 80*a* and 80*b*, and four alignment holes 86*a-d* are formed in the guide member 28 in a square pattern centered about the center post 84. Cam surfaces 88*a* and 88*b* are formed on the detent members 80*a* and 80*b* above the detent projections 82*a* and 82*b*, respectively. The detent members 80*a* and 80*b* are slightly deformable towards each other.

The second attachment portions 72 comprise a detent opening 90 formed in the guide member 28. The example detent opening 90 is square and is defined by four detent edges 92*a-d*. Four alignment pegs 94*a-d* extend from the edge surface 56*a* in a square pattern centered about the detent opening 90. The pattern of the alignment pegs 94 matches the pattern of the alignment holes 86 described above.

In use, first and second guide members 28*a* and 28*b* are displaced relative to each other such that the alignment pegs 94 are aligned with the alignment holes 86 and then such that the detent members 80 enter the detent opening 90. The cam surfaces 88 on the detent members 80 first engage the detent edges 92 to displace the detent members 80*a* and 80*b* towards each other. The detent projections 82*a* and 82*b* on the detent members 80*a* and 80*b* may thus move through the detent opening 90 and past the detent edges 92. At the same time, the alignment pegs 94 enter the alignment holes 86.

When the detent projections 82*a* and 82*b* clear the detent edges 92, the detent members 80*a* and 80*b* spring away from each other such that the detent projections 82*a* and 82*b* engage the detent edges to prevent inadvertent movement of the first guide member 28*a* relative to the second guide member 28*b*. The alignment pegs 94 engage the alignment holes 86 to prevent rotation of the guide members 28*a* and 28*b* relative to each other.

To separate the first and second guide members 28*a* and 28*b*, the cam surfaces 88 of the detent members 80 are pinched together to displace the detent members 80*a* and 80*b* towards each other. When the distance between the detent projections 82*a* and 82*b* is less than the distance between the opposing detent edges 92 adjacent to the detent projections 82*a* and 82*b*, the detent members 80 can be withdrawn from the detent opening 90. At the same time, the alignment pegs 94 are withdrawn from the alignment holes 86.

Figure 9:
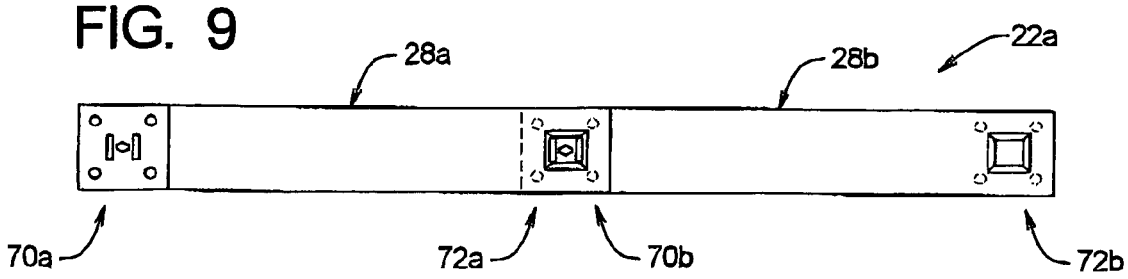
FIGS. 9 and 10 are top plan views of first and second alternate configurations of the guide system of FIG. 1.
Figure 9A:
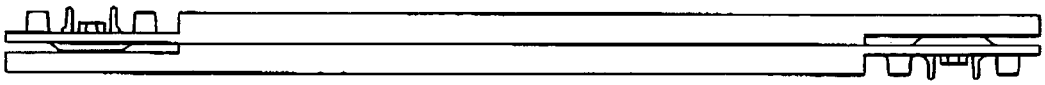
FIG. 9A is a side elevation view depicting a fourth, storage configuration, of the guide system as shown in FIG. 9.
Figure 10:
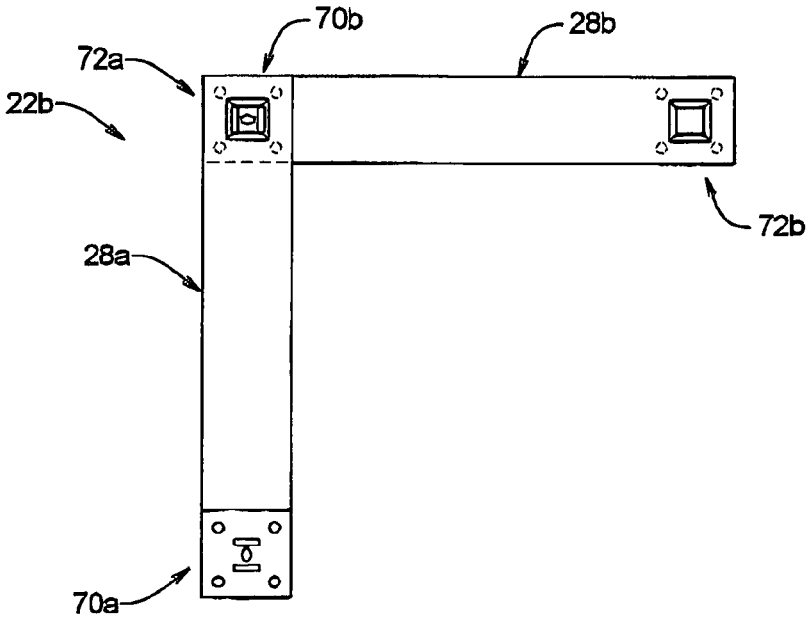

The attachment portions 70 and 72 of the example guide system 22*a* allow the guide members 28*a* and 28*b* to be placed in any one of four configurations relative to each other. Two of these configurations are illustrated in FIGS. 9 and 10. A third configuration is similar to the configuration shown in FIG. 10, but the first guide member 28*a* would extend up in FIG. 10 rather than down as shown. As shown in FIG. 9A, the fourth configuration is a storage configuration in which the exposed faces 50 of the guide members 28*a* and 28*b* abut each other.

The guide members 28 can be easily formed of plastic using injection molding with the attachment portions 70 and 72 integrally formed thereon. However, other attachment mechanisms can be used by a guide system falling within the scope of the present invention.

The inking system 20 described above can take on many different configurations and can be used in many different ways. Several different examples of configurations of the inking system 20 will now be described. The configurations described herein, including the configuration depicted in FIGS. 1-10, are included as examples only, and the present invention in its broadest form may take on other configurations and may be used in other forms.

Figure 11:
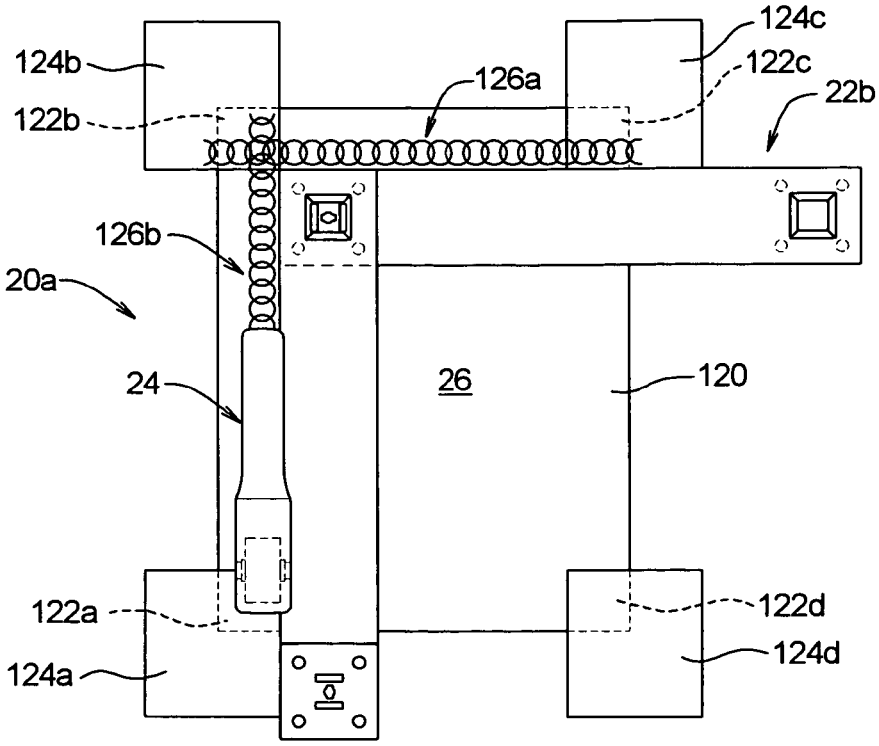
FIGS. 11 and 12 are top plan views depicting another inking system comprising a guide system, a continuous inking assembly, and masking sheets.
Figure 12:
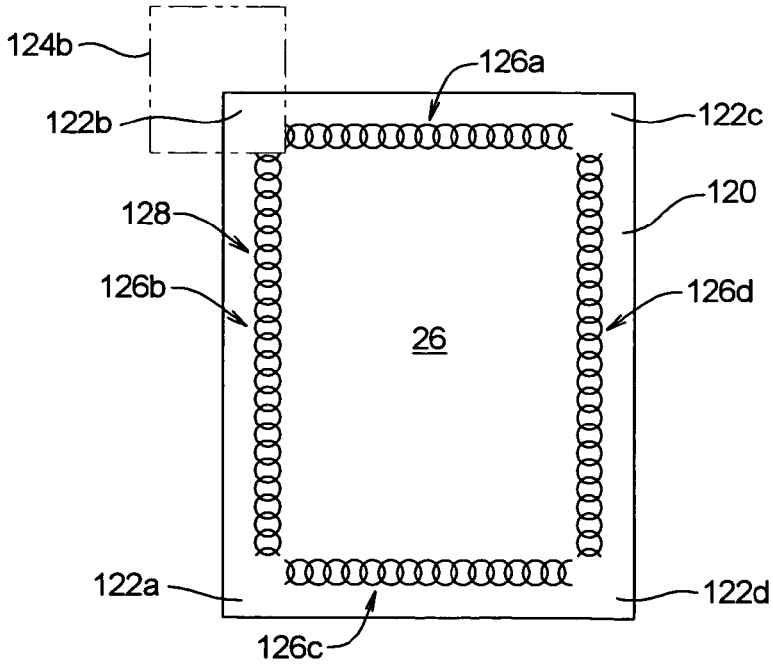

Referring now to FIGS. 11 and 12, depicted therein is another example inking system 20*a* of the present invention. The inking system 20*a* comprises the guide system 22 in the third configuration shown in FIG. 10 and the inking assembly 24 described above. The inking system 20*a* is used to applying ink to a sheet of paper 120 defining four corner portions 122*a-d*. The sheet of paper 120 defines the printing surface 26. The system 20*a* further comprises at least one, and in this case four, masking sheets 124*a-d* symmetrically arranged on the corner portions 122*a-d* of the paper 120.

The masking sheets 124 are used to mask off the corner portions 122 and the guide system 22 is arranged to extend between first and second sets of adjacent corner portions (122*a*,122*b*) and (122*b*,122*c*). With the guide system 22 acting as a guide, the inking assembly 24 is then used to form first and second image segments 126*a* and 126*b* as shown in FIG. 11. The guide system 22 is then arranged to extend between the third and fourth sets of adjacent corner portions (122*a*, 122*d*) and (122*d*,122*c*) and used to guide the inking assembly to form third and fourth image segments 126*c* and 126*d*.

The guide system 22*b* and masking sheets 124 are then removed as shown in FIG. 12 to reveal a composite image 128 formed by the image segments 126*c-d*. The image segments 126*c-d* extend along the borders of the paper 120 but do not overlap in the corner regions 122 because of the removed masking sheets 124.

Figure 13:
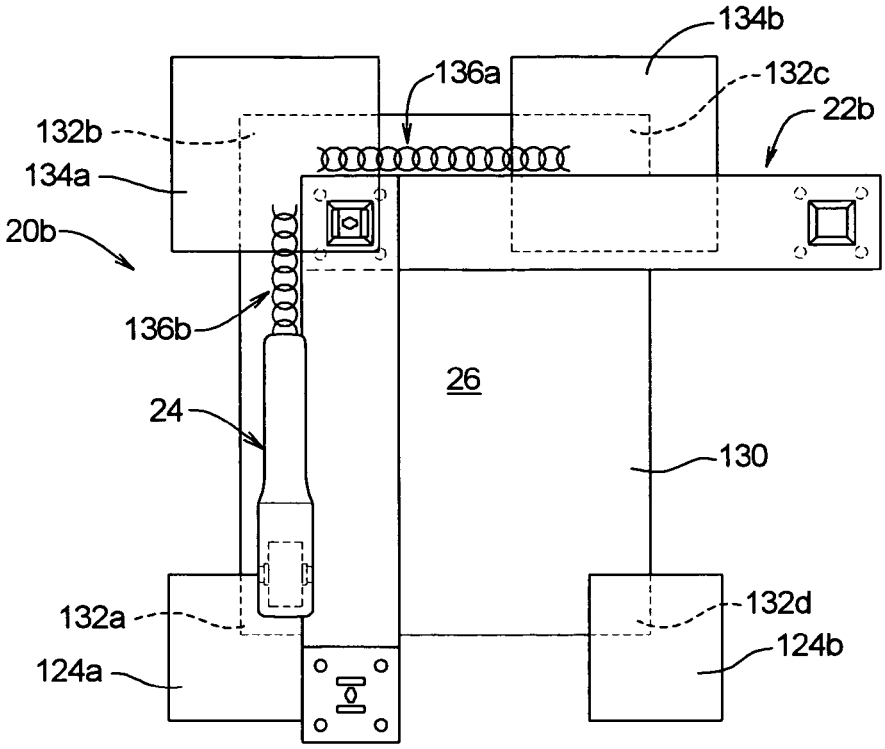
FIGS. 13 and 14 are top plan views depicting another inking system comprising a guide system, a continuous inking assembly, and masking sheets.
Figure 14:
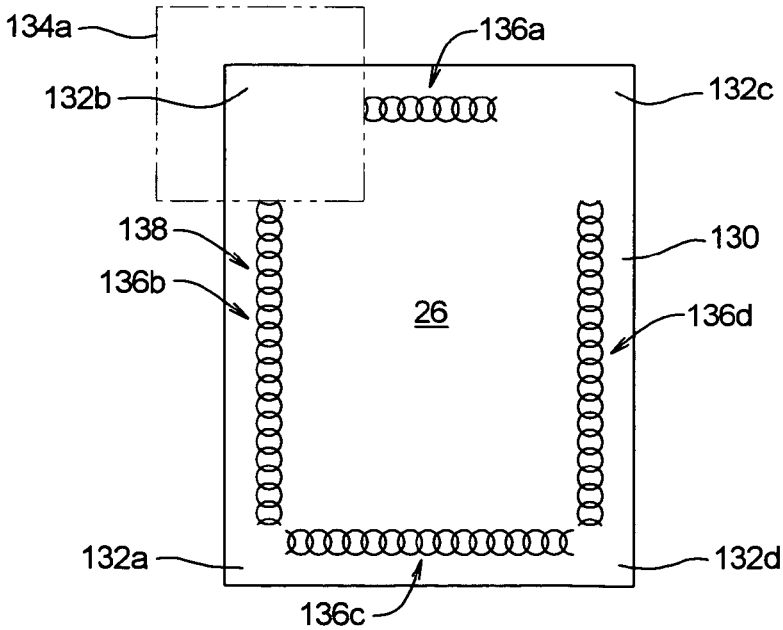
Figure 15:
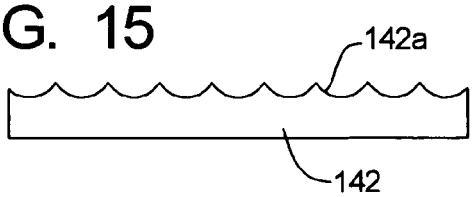
FIGS. 15-18 are top plan views depicting an inking system comprising a guide system, a continuous inking assembly, masking sheets, and a masking strip.

Referring now to FIGS. 13 and 14, depicted therein is another example inking system 20*b* of the present invention. The inking system 20*b* comprises the guide system 22 in the third configuration shown in FIG. 10 and the inking assembly 24 described above. The inking system 20*b* is used to apply ink to a sheet of paper 130 defining four corner portions 132*a-d*. The sheet of paper 130 defines the printing surface 26. The system 20*b* further comprises two masking sheets 124*a,b* as depicted above and two masking sheets 134*a,b*.

The masking sheets 124 and 134 are used in a manner similar to that described with respect to the system 120 described above. However, the masking sheets 134*a,b* are larger than the masking sheets 124*a,b*; the masking sheets 134*a,b* are applied to the corner portions 132*b* and 132*c* such that a larger portion of the corner portions 132*b* and 132*c* are masked off than of the corner portions 132*a* and 132*d*.

With the guide system 22 acting as a guide, the inking assembly 24 is then used to form first and second image segments 136*a* and 136*b* as shown in FIG. 13. The guide system 22 is then arranged to extend between the third and fourth sets of adjacent corner portions (132*a*,132*d*) and (132*d*,132*c*) and used to guide the inking assembly to form third and fourth image segments 136*c* and 136*d*.

The guide system 22*b* and masking sheets 134 are then removed as shown in FIG. 14 to reveal a composite image 138 formed by the image segments 136*c-d*. Like the image segments 128 described above, the image segments 136*c-d* extend along the borders of the paper 130 but do not overlap in the corner regions 132 because of the removed masking sheets 124 and 134.

Referring now to FIGS. 15-18, depicted therein is another example inking system 20*c* of the present invention. The inking system 20*c* comprises the guide system 22 in the third configuration shown in FIG. 10 and an inking assembly (not shown). The inking system 20*c* is used to apply ink to a sheet of paper 140. The sheet of paper 140 defines the printing surface 26. The system 20*c* further comprises an edge masking strip 142 and two masking sheets 144*a,b* similar to the sheets 124 depicted above.

The masking sheets 144 are used in a manner similar to that described with respect to the system 120 described above. In particular, the masking sheets 144*a,b* are used to mask off corner portions of the paper 140. In addition, the edge masking strip 142, which defines a shaped edge 142*a*, is arranged between the masking sheets 144*a,b* as shown in FIGS. 16 and 17.

Figure 16:
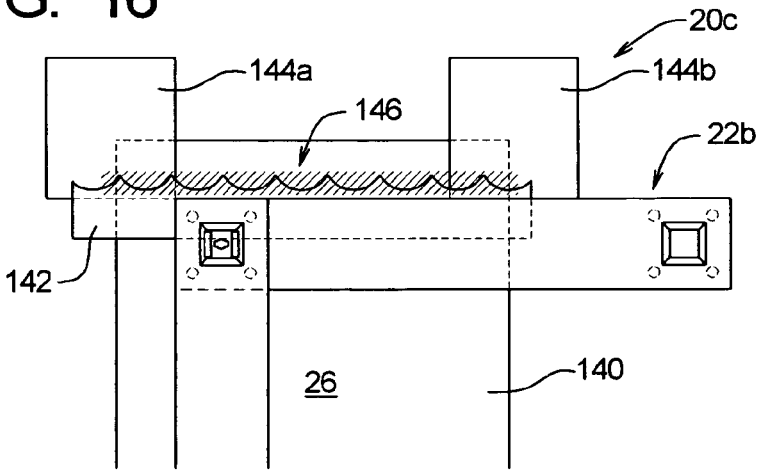
Figure 17:
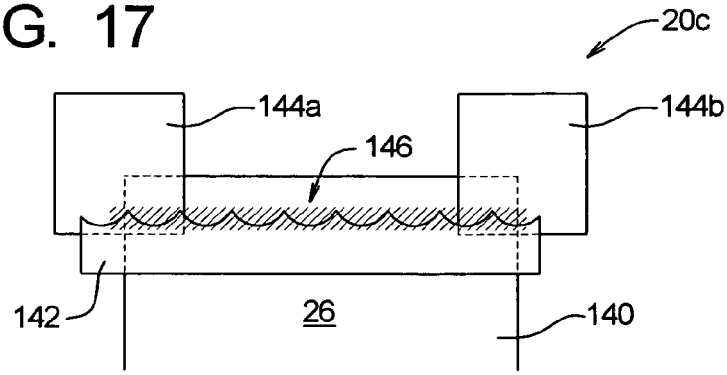
Figure 18:
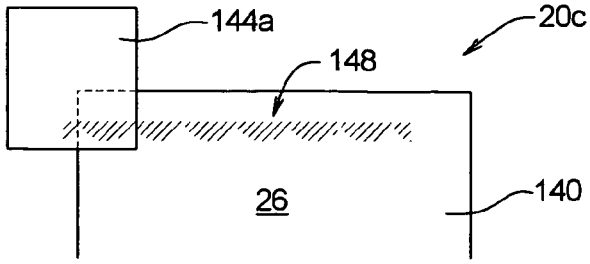
Figure 19:
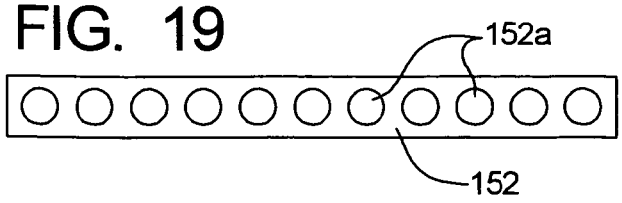
FIGS. 19-22 are top plan views depicting an inking system comprising a guide system, a continuous inking assembly, masking sheets, and a masking strip.

With the guide system 22 acting as a guide, the inking assembly is then used to form a full image segment 146, as shown in FIGS. 16 and 17, that extends along the shaped edge 142*a* between the masking sheets 144*a* and 144*b*. The guide system 22*b*, masking strip 142, and masking sheets 144 are then removed as shown in FIG. 18 to reveal a remaining image 148 formed by the portion of the full image segment 146 not removed with the masking strip 142 and masking sheets 144. As shown in FIG. 18, the inking system 20*c* allows the formation of continuous images that are not only terminated cleanly, but which can be modified along their entire length by the configuration of the shaped edge 142*a*.

Referring now to FIGS. 19-22, depicted therein is another example inking system 20*d* of the present invention. The inking system 20*d* comprises the guide system 22 in the third configuration shown in FIG. 10 and an inking assembly (not shown). The inking system 20*d* is used to apply ink to a sheet of paper 150. The sheet of paper 150 defines the printing surface 26. The system 20*d* further comprises a hole masking strip 152 and two masking sheets 154*a,b* similar to the sheets 124 depicted above.

The masking sheets 154 are used in a manner similar to that described with respect to the system 120 described above. In particular, the masking sheets 154*a,b* are used to mask off corner portions of the paper 150. In addition, the hole masking strip 152, which defines a series of holes 152*a*, is arranged between the masking sheets 154*a,b* as shown in FIGS. 20 and 21.

Figure 20:
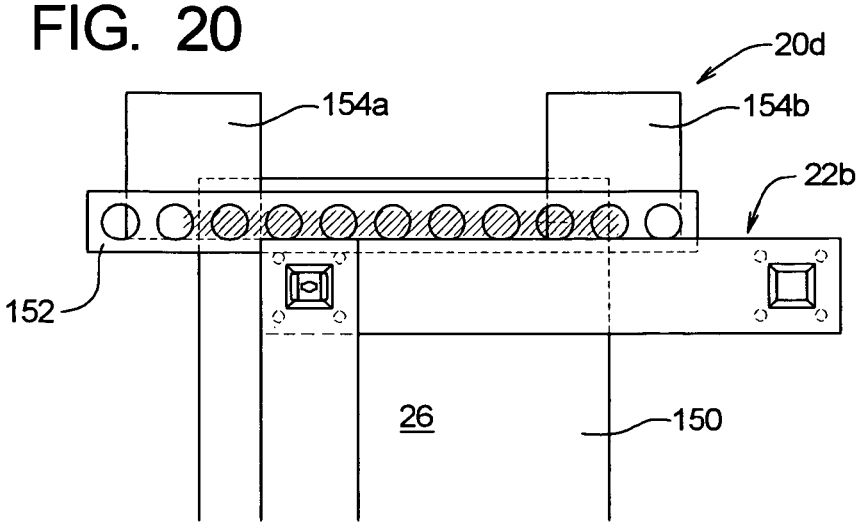
Figure 21:
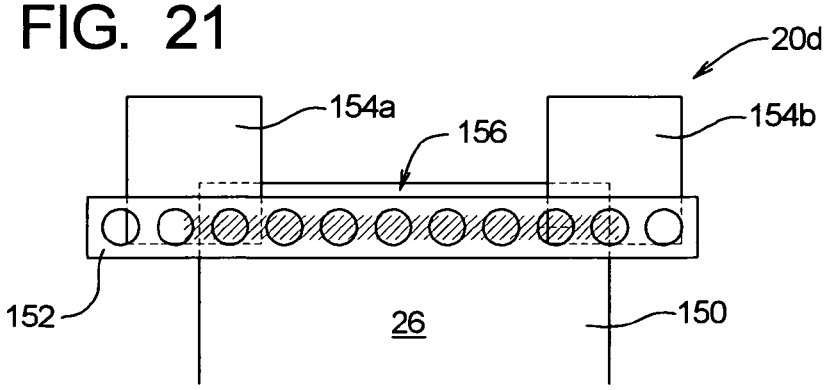
Figure 22:
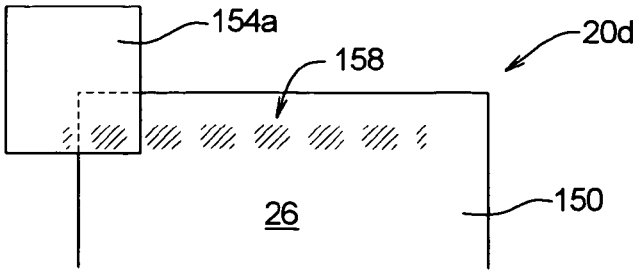

With the guide system 22 acting as a guide, the inking assembly is then used to form a full image segment 156, as shown in FIGS. 20 and 21, that extends along the hole masking strip 152 between the masking sheets 154*a* and 154*b*. The guide system 22*b*, masking strip 152, and masking sheets 154 are then removed as shown in FIG. 22 to reveal a remaining image 158 formed by the portion of the full image segment 156 not removed with the masking strip 152 and masking sheets 154. As shown in FIG. 22, the inking system 20*c* allows the formation of continuous images that are not only terminated cleanly, but which can be modified along their entire length by the arrangement of the holes 152*a*.

Figure 23:
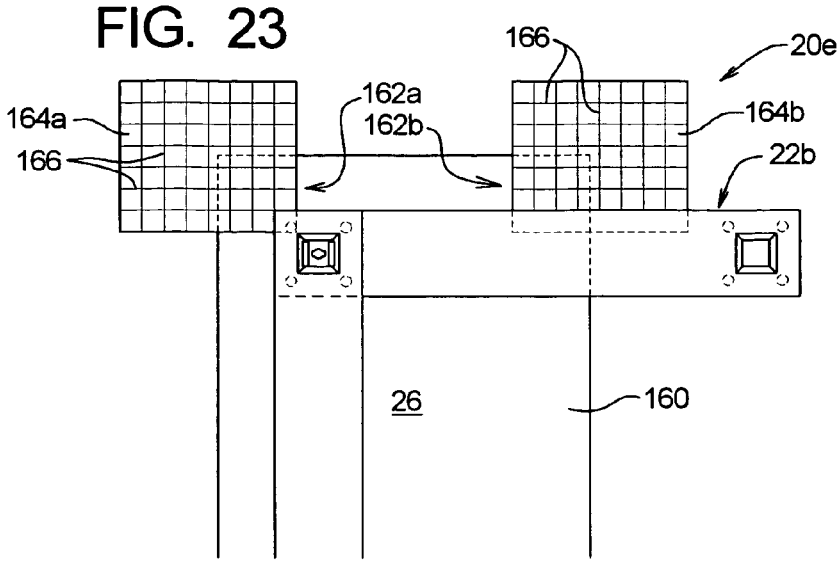
FIG. 23 is a top plan view depicting an inking system comprising a guide system and lined masking sheets.

Referring now to FIG. 23, depicted therein is another example inking system 20*e* of the present invention. The inking system 20*e* comprises the guide system 22 in the third configuration shown in FIG. 10 and an inking assembly (not shown). The inking system 20*e* is used to apply ink to a sheet of paper 160. The sheet of paper 160 defines the printing surface 26 and first and second corner portions 162*a* and 162*b*. The system 20*d* further comprises two masking sheets 164*a,b*.

The first and second masking sheets 164*a* and 164*b* are similar to the sheets 124 depicted above and are applied to the first and second corner portions 162*a* and 162*b* in a similar manner. However, the sheets 164*a* and 164*b* are cross-hatched with guide lines 166 that help to align the sheets 164, as well as the guide system 22, with the corners of the paper 160.

Figure 24:
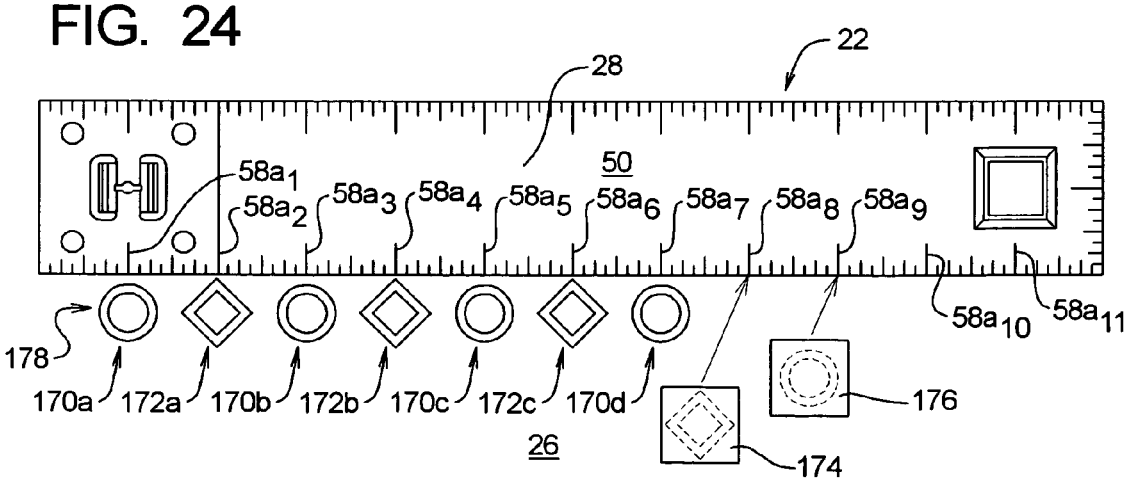
FIG. 24 is a top plan view depicting an inking system comprising a guide system and flat inking assemblies.

FIG. 24 illustrates that any one of the guide systems described above may be used to facilitate the formation of ink images formed by flat ink assemblies as well as continuous ink assemblies such as the assembly 24 described above. FIG. 24 shows that the guide system 20 formed by the guide member 28 can be used to align discrete images formed by flat inking assemblies. More specifically, FIG. 24 illustrates that ink images 170 and 172 associated with first and second ink stamps 174 and 176 can be formed in equal spaced succession along a straight line.

The first group of indicia 58*a* takes the form of discrete indicating lines $\mathbf{58}a_{1\text{-}11}$, which, as illustrated in FIG. 24, are equally spaced along the length of the guide member 28. In the example shown in FIG. 24, the first stamp 174 is used to form a first round ink image 170*a* at the first indicating line $\mathbf{58}a_1$. The second stamp 176 is then used to a first rectangular ink image at the second indicating line $\mathbf{58}a_2$. This process is repeated as shown until a composite image 178 formed of a desired number of images is formed.

Referring now to FIGS. 25-28, depicted therein is the construction and use of another example inking system 20*e* of the present invention. The inking system 20*e* comprises the guide system 22 in the third configuration shown in FIG. 10 and an inking assembly (not shown). The inking system 20*e* is used to apply ink to a sheet of paper 190. The sheet of paper 190 defines the printing surface 26. The system 20*e* further comprises two masking sheets 192*a,b*.

Figure 25:
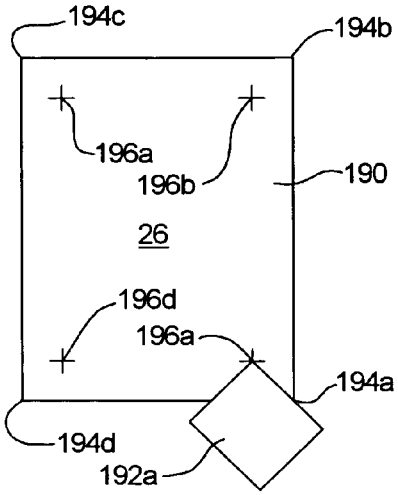
FIGS. 25-28 are top plan views depicting another example method of using an inking system comprising a guide system, a continuous inking assembly, and masking sheets.

The masking sheets 192*a,b* are used to mask off portions of the corners 194*a,b,c,d* of the sheet of paper 190. In particular, as shown in FIG. 25, marks 196*a,b,c,d* are formed adjacent to each of the corners 194*a,b,c,d*, respectively. The marks 196 are preferably temporary and may be formed by light pencil marks. The masking sheets 192*a,b* are arranged between the marks 196*a,b* and the corners 194*a,b*; in the example shown in FIGS. 25-28, edges of the masking sheets 192*a,b* extend at an angle of approximately 45° with respect to the edges of the sheet 190 that intersect at the corners 194*a,b*.

Figure 26:
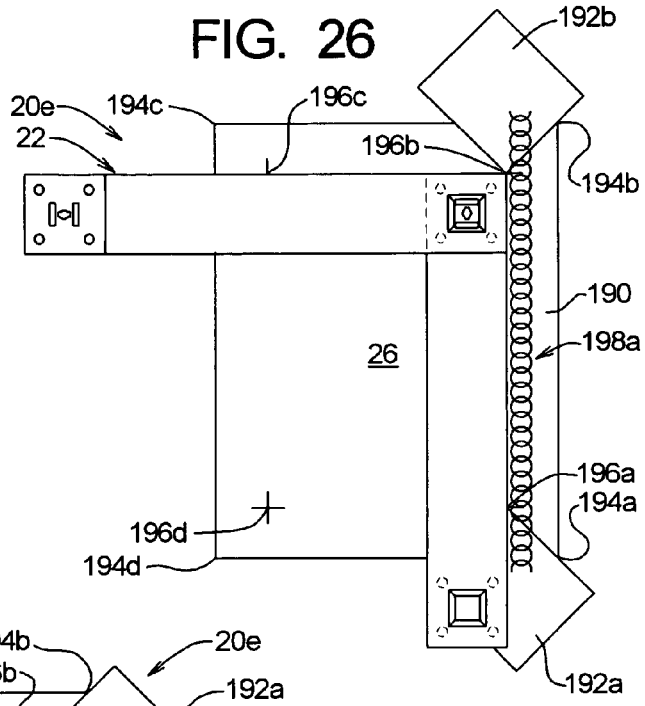
Figure 27:
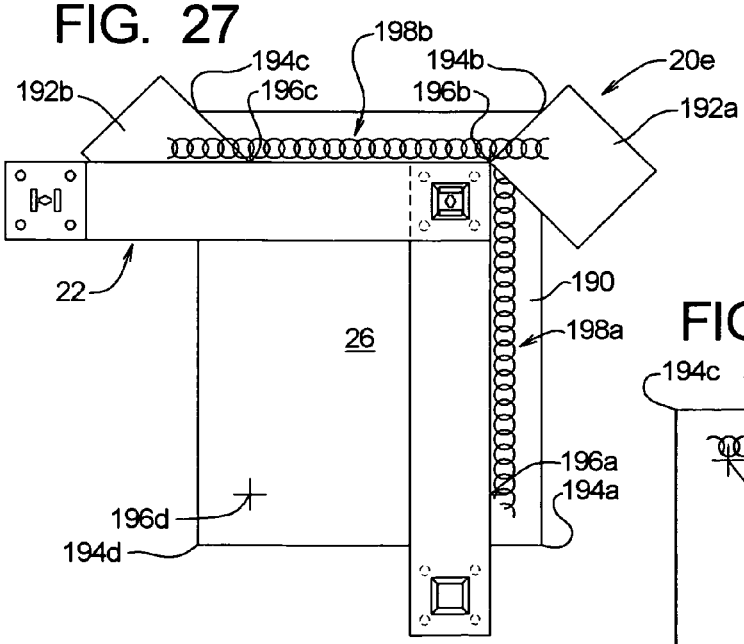
Figure 28:
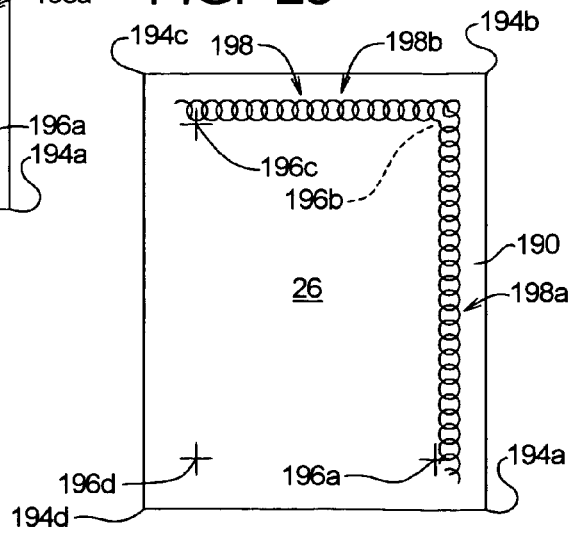

With the guide system 22 acting as a guide and arranged along the marks 196*a,b,c*, the inking assembly is then used to form image segments 198*a,b*, as shown in FIGS. 26-28, that extend along the edges of the sheet 190 between the corners 194*a* and 194*b* and between the corners 194*b* and 194*c*. The masking sheets 192*a,b* are repositioned to block out portions of the image segments 198 as appropriate for the desired image. The image segments 198*a,b* form a composite image 198 as shown in FIGS. 27 and 28.

This process may be repeated along the edges of the sheet 190 between the corners 194*c* and 194*d* and between the corners 194*d* and 194*a* such that the composite image 198 extends along all four edges of the sheet 190. When the complete image 198 extends along all four edges of the sheet 190, the image segments are terminated at complimentary angles adjacent to the corners 194*a,b,c,d* that yield a finished, "mitered" look that is aesthetically desirable. When the ink used to form the image 198 is dry, the marks 196 may be removed.

Figure 29:
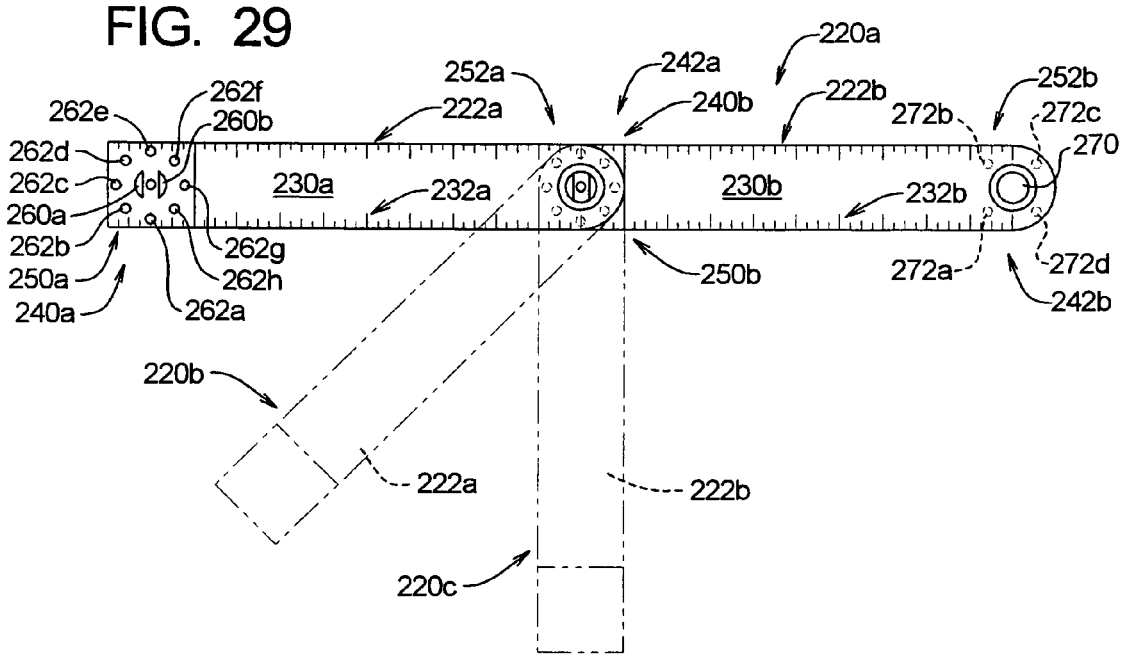
FIG. 29 is a top plan view depicting a guide system that may be used in three different configurations.

Referring now to FIG. 29, depicted therein is another example guide system 220 that may be used by the present invention. The guide system 220 is shown in solid lines in a first configuration 220*a* and in broken lines in second and third configurations 220*b* and 220*c*. Other configurations of the system 220 are possible as described above with respect to FIGS. 10 and 11.

The guide system 220 comprises a plurality of guide members 222. When used in relation to the guide system 220, the suffixes "a" through "c" are used in FIG. 29 to distinguish among the various configurations in which the system 220 may be placed. The first and second guide members 222*a* and 222*b* are identical in the example guide systems 220. The suffixes "a" and "b" are used in FIG. 29 to describe first and second guide members 222*a* and 222*b* and the features thereof. Suffixes will be used in the following discussion only when necessary to distinguish among the various configurations of the guide system 220 or to distinguish between the first and second guide members 222*a* and 222*b*.

The guide members 222 are similar to the guide member 28 described above in that they each defining an exposed surface 230 on which indicia 232 are formed. The guide members each define a first end 240 and a second end 242.

In addition, like the guide members 28 described above, a first attachment portion 250 is formed on each of the first ends 240, and a second attachment portion 252 is formed on each of the second ends 242. The attachment portions 250 and 252 are similar to the attachment portions 70 and 72 and will be described herein primarily to the extent that they differ from the portions 70 and 72.

The first attachment portions 250 each comprise one or more detent members 260 and a plurality of alignment holes 262. In particular, the attachment portions 250 define eight alignment holes 262 arranged in two square patterns around the detent members 260. In addition, the example detent members 260 are rounded.

The second attachment portions 252 comprise a round detent opening 270 and four alignment pegs 272 arranged in a square pattern matching the square patterns defined by the alignment holes 262.

As shown by comparing the various configurations 220*a*, 220*b*, and 220*c* shown in FIG. 25, it can be seen that the attachment portions 250 and 252 allow additional angles to be formed between the guide members 222*a* and 222*b*.

Figure 30:
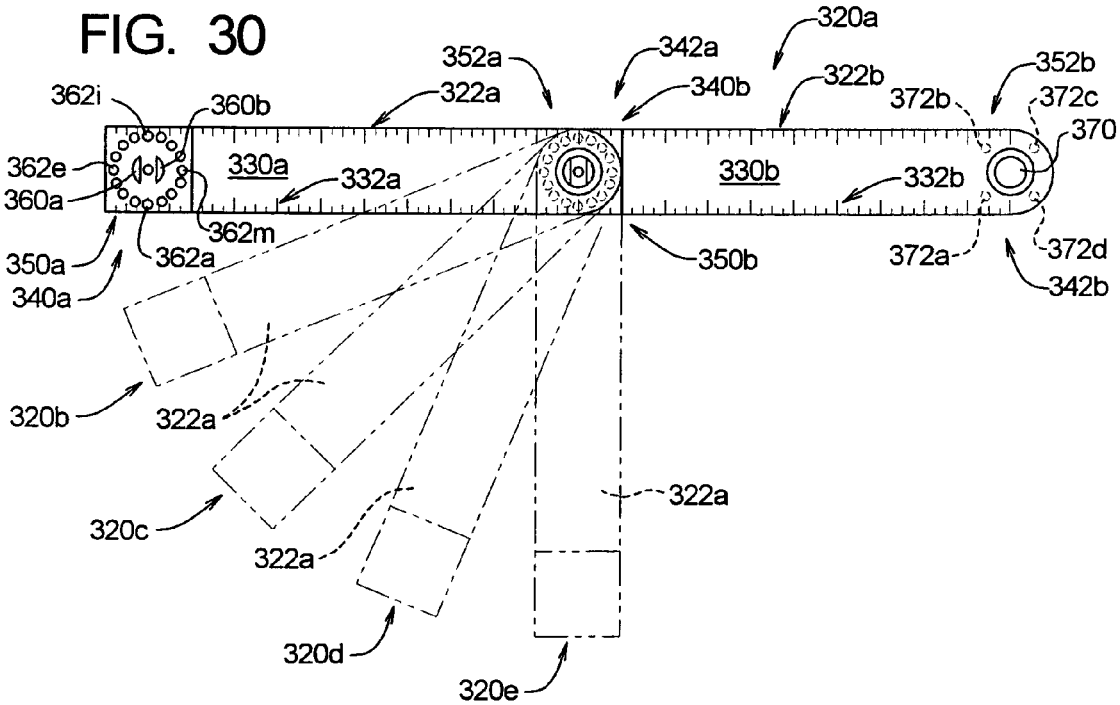
FIG. 30 is a top plan view depicting a guide system that may be used in five different configurations.

Referring now to FIG. 30, depicted therein is another example guide system 320 that may be used by the present invention. The guide system 320 is shown in solid lines in a first configuration 320*a* and in broken lines in second, third, fourth, and fifth configurations 320*b*, 320*c*, 320*d*, and 320*e*. Other configurations of the example guide system 320 are possible as described above with respect to FIGS. 10 and 11.

The guide system 320 comprises a plurality of guide members 322. When used in relation to the guide system 320, the suffixes "a" through "e" are used in FIG. 29 to distinguish among various configurations in which the system 320 may be placed. The example guide system 320 comprises identical first and second guide members 322*a* and 322*b*. The suffixes "a" and "b" are used in FIG. 30 to describe the first and second guide members 322*a* and 322*b* and the features thereof. Suffixes will be used in the following discussion only when necessary to distinguish among the various configurations of the guide system 320 or to distinguish between the first and second guide members 322*a* and 322*b*.

The guide members 322 are similar to the guide member 28 described above in that they each defining an exposed surface 330 on which indicia 332 are formed. The guide members each define a first end 340 and a second end 342.

In addition, like the guide members 28 described above, a first attachment portion 350 is formed on each of the first ends 340, and a second attachment portion 352 is formed on each of the second ends 342. The attachment portions 350 and 352 are similar to the attachment portions 70, 72 and 250,252 described above and will be described herein primarily to the extent that they differ therefrom.

The first attachment portions 350 each comprise one or more detent members 360 and a plurality of alignment holes 362. In particular, the attachment portions 350 define sixteen alignment holes 362 arranged in four square patterns around the detent members 360. In addition, the example detent members 360 are rounded.

The second attachment portions 352 comprise a round detent opening 370 and four alignment pegs 372 arranged in a square pattern matching the square patterns defined by the alignment holes 362.

As shown by comparing the various configurations 320*a*, 320*b*, 320*c*, 320*d*, and 320*e* shown in FIG. 30, it can be seen that the attachment portions 350 and 352 allow additional angles to be formed between the guide members 322*a* and 322*b*.

The number of angles can thus be increased by employing more alignment holes. As another option, the alignment holes and projections can be replaced with matching grooves and projections that radially extend from an axis defined by the attachment portions. Also, a circular groove with a matching detent projection may be provided to allow the guide members 322*a* and 322*b* to extend at any angle within a range of angles. In this case, a screw type apparatus may be used to fix the guide members 322*a* and 322*b* in a desired angular relationship.

From the foregoing, it should be apparent that the present invention may be embodied in many different combinations and sub-combinations of the elements and steps described above. The scope of the present invention should thus be determined by the following claims and not the foregoing detailed description.

I claim:

1. A guide system comprising a plurality of guide members, where each guide member comprises:

an exposed surface;

a first end portion comprising at least one detent member, where the at least one detent member defines a detent projection and is deformable;

a second end portion defining at least first, second, and third detent edges, where the detent edges define a detent opening;

an intermediate portion arranged between the first and second end portions such that each guide member defines a longitudinal axis; where the guide system operates in a storage configuration in which the at least one detent member of a first guide member of the plurality of guide members extends through the detent opening of a second guide member of the plurality of guide members such that the detent projection defined by the at least one detent member of the first guide member engages the first detent edge defined by the second guide member, the at least one detent member of the second guide member extends through the detent opening of the second guide member such that the detent projection defined by the at least one detent member of the first guide member engages the first detent edge defined by the second guide member, and the exposed faces of the first and second guide members substantially abut each other;

a first use configuration in which the at least one detent member of the first guide member extends through the detent opening of the second guide member such that the detent projection defined by the at least one detent member of the first guide member engages the second detent edge defined by the second guide member, the longitudinal axes of the first and second guide members are substantially co-linear, and the exposed faces of the first and second guide members are substantially coplanar; and a second use configuration in which the at least one detent member of the first guide member extends through the detent opening of the second guide member such that the detent projection defined by the at least one detent member of the first guide member engages the third detent edge defined by the second guide member, the longitudinal axes of the first and second guide members are substantially perpendicular, and the exposed faces of the first and second guide members are substantially coplanar.

2. A guide system as recited in claim 1, in which the second end portion further defines a fourth detent edge that defines the detent opening, where the guide system further operates in a third use configuration in which the at least one detent member of the first guide member extends through the detent opening of the second guide member such that the detent projection defined by the at least one detent member of the first guide member engages the fourth detent edge defined by the second guide member, the longitudinal axes of the first and second guide members are substantially perpendicular, and the exposed faces of the first and second guide members are substantially coplanar.

3. A guide system as recited in claim 2, in which the first end portions of the guide members define first and second detent members.

4. A guide system as recited in claim 3, in which:

in the storage configuration the first and second detent members of the first guide member extend through the detent opening of the second guide member such that the detent projections defined by the first and second detent members of the first guide member engage the third and first detent edges, respectively, defined by the second guide member, and the first and second detent members of the second guide member extend through the detent opening of the second guide member such that the detent projections defined by the first and second detent members of the first guide member engages the third and first detent edges, respectively, defined by the second guide member;

in the first use configuration, the first and second detent members of the first guide member extend through the detent opening of the second guide member such that the detent projections defined by the first and second detent members of the first guide member engage the first and third detent edges, respectively, defined by the second guide member;

in the second use configuration, the first and second detent members of the first guide member extend through the detent opening of the second guide member such that the detent projections defined by the first and second detent members of the first guide member engage the second and fourth detent edges, respectively, defined by the second guide member; and in the third use configuration, the first and second detent members of the first guide member extend through the detent opening of the second guide member such that the detent projections defined by the first and second detent members of the first guide member engage the fourth and second detent edges, respectively, defined by the second guide member.

5. A guide system as recited in claim 3, in which the first and second detent members are deformable towards each other.

6. A guide system as recited in claim 5, further comprising cam surfaces formed on the detent projections to facilitate deformation of the first and second detent members when inserting the first and second detent members through the detent opening.

7. A guide system as recited in claim 5, in which the first and second detent members are pinched together to facilitate deformation of the first and second detent members when removing the first and second detent members from the detent opening.

8. A guide system as recited in claim 3, in which the first end portions of the guide members further comprise a center post arranged between the first and second detent members.

9. A guide system as recited in claim 3, further comprising:

a plurality of alignment pegs extending from the second end portions; and a plurality of alignment openings formed in the first end portions; wherein the alignment openings receive the alignment pegs to inhibit relative rotation between the first and second guide members when the guide members are in the first, second, and third use configurations.

10. A guide system as recited in claim 9, in which:

four alignment pegs extends from the second end portions; and four alignment openings are formed in the first end portions; wherein the alignment openings receive the alignment pegs to inhibit relative rotation between the first and second guide members when the guide members are in the first, second, and third use configurations.

11. A guide system as recited in claim 1, in which the detent member edges are spaced from a plane defined by the exposed surface.

12. A guide system as recited in claim 1, further comprising:

at least one alignment peg extending from one of the first and second end portions; and at least one alignment opening formed in another of the first and second end portions; wherein the at least one alignment opening receives the at least one alignment peg to inhibit relative rotation between the first and second guide members when the guide members are in the first and second use configurations.

13. A method of providing a guide assembly, comprising the steps of:

providing first and second guide members, where each of the first and second guide member comprises an exposed surface, a first end portion comprising first and second detent members, where the first and second detent members each defines a detent projection and is deformable, a second end portion defining a plurality of detent edges, where the detent edges define a detent opening, and an intermediate portion arranged between the first and second end portions such that each guide member defines a longitudinal axis;

arranging the first and second guide members in a storage configuration in which the exposed faces of the first and second guide members abut each other by inserting the first and second detent members of the first guide member through the detent opening of the second guide member such that the detent projections defined by the first and second detent members of the first guide member engage two of the detent edges defined by the second guide member, and inserting the first and second detent members of the second guide member through the detent opening of the first guide member such that the detent projections defined by the first and second detent members of the second guide member engage two of the detent edges defined by the first guide member;

arranging the first and second guide members in a first use configuration in which the longitudinal axes of the first and second guide members are substantially co-linear and the exposed faces of the first and second guide members are substantially coplanar by inserting the first and second detent members of the first guide member through the detent opening of the second guide member such that the detent projections defined by the first and second detent members of the first guide member engage two of the detent edges defined by the second guide member; and arranging the first and second guide members in a second use configuration in which the longitudinal axes of the first and second guide members are substantially perpendicular and the exposed faces of the first and second guide members are substantially coplanar by inserting the first and second detent members of the first guide member through the detent opening of the second guide member such that the detent projections defined by the first and second detent members of the first guide member engage two of the detent edges defined by the second guide member.

14. A method as recited in claim 13, further comprising the step of arranging the first and second guide members in a third use configuration in which the longitudinal axes of the first and second guide members are substantially perpendicular and the exposed faces of the first and second guide members are substantially coplanar by inserting the first and second detent members of the first guide member through the detent opening of the second guide member such that the detent projections defined by the first and second detent members of the first guide member engage two of the detent edges defined by the second guide member.

15. A method as recited in claim 13, in which the step of inserting the first and second detent members through the detent opening comprises the steps of:

forming cam surfaces on the detent projections; and displacing the first and second detent members such that the cam surfaces engage two detent edges to deform the first and second detent members towards each other.

16. A method as recited in claim 13, further comprising the step of pinching the first and second detent members towards each other to allow the first and second detent members to be removed from the detent opening.

17. A guide system comprising first and second guide members, where each of the first and second guide members comprises:

an exposed surface;

a first end portion comprising first and second detent members, where each of the first and second detent members defines a detent projection and is deformable;

a second end portion defining first, second, third, and fourth detent edges, where the detent edges define a detent opening that is substantially square in shape; and an intermediate portion arranged between the first and second end portions such that each guide member defines a longitudinal axis; where the guide system operates in a storage configuration in which the first and second detent members of the first guide member extend through the detent opening of the second guide member such that the detent projections defined by the first and second detent members of the first guide member engage the third and first detent edges, respectively, defined by the second guide member, and the first and second detent members of the second guide member extend through the detent opening of the second guide member such that the detent projections defined by the first and second detent members of the first guide member engages the third and first detent edges, respectively, defined by the second guide member, and the exposed faces of the first and second guide members substantially abut each other;

a first use configuration in which the first and second detent members of the first guide member extend through the detent opening of the second guide member such that the detent projections defined by the first and second detent members of the first guide member engage the first and third detent edges, respectively, defined by the second guide member, the longitudinal axes of the first and second guide members are substantially co-linear, and the exposed faces of the first and second guide members are substantially coplanar; and a second use configuration in which the first and second detent members of the first guide member extend through the detent opening of the second guide member such that the detent projections defined by the first and second detent members of the first guide member engage the second and fourth detent edges, respectively, defined by the second guide member, the longitudinal axes of the first and second guide members are substantially perpendicular, and the exposed faces of the first and second guide members are substantially coplanar; and a third use configuration in which the first and second detent members of the first guide member extend through the detent opening of the second guide member such that the detent projections defined by the first and second detent members of the first guide member engage the fourth and second detent edges, respectively, defined by the second guide member, the longitudinal axes of the first and second guide members are substantially perpendicular, and the exposed faces of the first and second guide members are substantially coplanar.

18. A guide system as recited in claim 17, in which the first and second detent members are deformable towards each other.

19. A guide system as recited in claim 17, further comprising cam surfaces formed on the detent projections to facilitate deformation of the first and second detent members when inserting the first and second detent members through the detent opening.

20. A guide system as recited in claim 17, in which the first and second detent members are pinched together to facilitate deformation of the first and second detent members when removing the first and second detent members from the detent opening.

21. A guide system as recited in claim 17, in which:

four alignment pegs extends from the second end portions; and four alignment openings are formed in the first end portions; wherein the alignment openings receive the alignment pegs to inhibit relative rotation between the first and second guide members when the guide members are in the first, second, and third use configurations.

* * * * *